US007819714B2

(12) United States Patent
Medford et al.

(10) Patent No.: US 7,819,714 B2
(45) Date of Patent: Oct. 26, 2010

(54) WATER ACTIVATED INFLATOR FOR INFLATABLE DEVICE AND METHOD OF AIR DEPLOYMENT

(75) Inventors: Ed Medford, Comox (CA); Ned Miljic, Belleville (CA)

(73) Assignee: Irvin Aerospace Canada Limited, Belleville, Ontario (CA)

( * ) Notice: Subject to any disclaimer, the term of this patent is extended or adjusted under 35 U.S.C. 154(b) by 133 days.

(21) Appl. No.: 12/213,420

(22) Filed: Jun. 19, 2008

(65) Prior Publication Data

US 2009/0098784 A1 Apr. 16, 2009

Related U.S. Application Data

(63) Continuation-in-part of application No. 11/115,174, filed on Apr. 27, 2005, now abandoned.

(60) Provisional application No. 60/566,170, filed on Apr. 29, 2004.

(51) Int. Cl.
*B63C 9/125* (2006.01)

(52) U.S. Cl. ..... 441/95

(58) Field of Classification Search ..... 441/92–101
See application file for complete search history.

(56) References Cited

U.S. PATENT DOCUMENTS 2,312,112 A * 2/1943 McNealy ..... 208/178
2,593,432 A 4/1952 Freas (Continued)

OTHER PUBLICATIONS

USPTO, for U.S. Appl. No. 11/115,174, 1st Office Action mailed May 2, 2007.

(Continued)

*Primary Examiner*—Ed Swinehart
(74) *Attorney, Agent, or Firm*—Freedman & Associates

(57) ABSTRACT

A water activated inflator and a method of air deployment of a water activated inflatable device are provided. A gas cylinder opening device for opening a sealing mechanism of a gas cylinder is disposed at least partially within a housing and is movable between a cocked position and a fired position along a first axis having a first orientation relative to the housing. A tension mechanism provides tension acting along the first axis for moving the gas cylinder opening device from the cocked position to the fired position. A plunger is holding the gas cylinder opening mechanism in the cocked position. The plunger is disposed in the housing and movable between a first position and a second position along a second axis having a second different orientation relative to the housing. A water soluble element is holding the plunger in the first position. A first interacting surface of the gas cylinder opening device is disposed at a predetermined angle to the first axis. A second interacting surface of the plunger is in contact with the first interacting surface at the predetermined angle. The angle is determined such that a component along the second axis of a component of the tension acting onto the second interacting surface is within a predetermined range for ensuring structural integrity of the water soluble element in the cocked position and for ensuring movement of the plunger when at least a portion of the water soluble element is dissolved. Using the water activated inflator in a rescue kit is highly beneficial for air rescue operations over a body of water by providing proper timing of the inflation shortly after impact.

21 Claims, 10 Drawing Sheets

U.S. PATENT DOCUMENTS

| | | | | |
|---|---|---|---|---|
| 2,894,658 | A | | 7/1959 | Spidy |
| 3,212,112 | A | * | 10/1965 | Reffell ..... 441/41 |
| 3,246,801 | A | | 4/1966 | De Boer |
| 3,247,350 | A | | 4/1966 | Davis |
| 3,526,339 | A | | 9/1970 | Bernhardt et al. |
| 3,802,012 | A | | 4/1974 | Middleton, Jr. |
| 4,247,143 | A | | 1/1981 | Putman |
| 4,639,229 | A | | 1/1987 | Wright et al. |
| 5,333,656 | A | | 8/1994 | Mackal |
| 5,370,567 | A | | 12/1994 | Glasa |
| 5,694,986 | A | | 12/1997 | Weinheimer et al. |
| 5,852,986 | A | | 12/1998 | Mackal |
| 6,589,087 | B2 | | 7/2003 | Mackal et al. |

OTHER PUBLICATIONS

USPTO, for U.S. Appl. No. 11/115,174, Office Communication mailed Sep. 26, 2007; Interview Summary.

U.S. Appl. No. 11/115,174, response to 1st Office Action filed Oct. 1, 2007.

USPTO, for U.S. Appl. No. 11/115,174, Final Office Action mailed Dec. 20, 2007.

* cited by examiner

WATER ACTIVATED INFLATOR FOR INFLATABLE DEVICE AND METHOD OF AIR DEPLOYMENT

FIELD OF THE INVENTION

The instant invention relates to air deployment of an inflatable device and in particular to a water activated inflator for use in an air deployable device and a method of air deployment using the same.

BACKGROUND

There is a continuing need for development of methods of accurately dropping inflatable devices from an aircraft, for example, life rafts to survivors in a body of water. The most advanced method, presently in use, is dropping an inflatable device in a deployment container using a parachute and a timer as disclosed, for example, in U.S. Pat. No. 4,639,229. Use of the parachute substantially ensures correct orientation of the container on impact with the body of water and a predetermined range of speed at impact through aerodynamically braking the descent of the container. After impact the container is partially or completely submerged in the water, bobbing in the water and then floating on the surface until the device is inflated. Using a timer, the inflation is initiated after a preset time interval elapses, predetermined at time of manufacturing the inflatable device based on an expected altitude of an aircraft flying above the water surface such that the inflation starts shortly after impact of the container on the body of water. However, the exact timing for initiating the inflation is a major problem of the method of air deployment using a timer. If the inflation is initiated too early, the device is inflated while still in the air resulting in the inflated device being blown away from a target zone in the presence of wind—even at a relatively small wind speed. On the other hand, if the inflation is initiated too late the container is floating on the surface for a considerable amount of time reducing the likelihood of the device being inflated in its proper orientation. In most rescue operations survivors have to be rescued from rough seas. Under such conditions it is likely for a container to be toppled by the rough sea while floating on the surface resulting in the device being inflated upside down rendering it problematic for rescuing survivors. One solution to this problem is the use of a reversible life raft as taught in U.S. Pat. No. 6,375,529. However, use of a reversible life raft requires physical action from survivors—people in distress—in order to set up a canopy for protecting them from the elements. In particular, for rescue operations in cold climates it is essential to provide life rafts with a canopy in order to protect survivors from hypothermia.

Auto-inflation of life vests and other personal floatation devices using water activated inflators is known in the art. Water activated inflators using a water soluble element for holding a membrane piercing mechanism in a cocked position are disclosed, for example, in U.S. Pat. Nos. 6,589,087; 5,852,986; 5,694,986; 5,370,567; and 5,333,656.

In order to quickly inflate a large floatation device such as a life raft, a large gas flow is needed. Therefore, the inflator has to quickly open a sealing mechanism of a gas cylinder containing a large volume of gas under high pressure. In order to quickly and reliably create a large opening, it is preferred to provide a sufficient stroke to a valve—defining the opening—of the sealing mechanism, rather than piercing a sealing membrane. However, for providing a sufficient stroke a relatively strong force acting along a relatively long distance is applied. Timed actuators, explosive actuators, and electronic actuators are typically used to provide the force and distance required in inflating a large inflatable device. As is evident to those of skill in the art, such devices cause serious storage and maintenance problems as well as safety problems during transport in an aircraft and, therefore, are not considered useful for air rescue missions. Conversely, none of the passive water activated devices provide for the force and distance of operation required for quickly and reliably inflating a life raft.

It would be advantageous to provide a passive water activated device for supporting inflation of a life raft.

SUMMARY OF EMBODIMENT OF THE INVENTION

In accordance with an embodiment of the present invention there is provided a water activated inflator comprising:

a gas cylinder opening device for opening a sealing mechanism of a gas cylinder, the gas cylinder opening device being disposed at least partially within a housing and being movable between a cocked position and a fired position along a first axis having a first orientation relative to the housing;

a tension mechanism in mechanical communication with the housing and the gas cylinder opening device for providing tension acting along the first axis for moving the gas cylinder opening device from the cocked position to the fired position;

a plunger for holding the gas cylinder opening device in the cocked position, the plunger being disposed in the housing and movable between a first position and a second position along a second axis having a second different orientation relative to the housing;

a water soluble element for holding the plunger in the first position through mechanical communication along the second axis with the plunger and the housing;

a conduit for providing water to the water soluble element;

a first interacting element in mechanical communication with the gas cylinder opening device having a first interacting surface, wherein a portion of the first interacting surface is disposed at a predetermined angle other than 90 or 180 degrees to the first axis; and, a second interacting element in mechanical communication with the plunger having a second interacting surface for interacting with the first interacting surface at the predetermined angle when the plunger is in the first position for holding the gas cylinder opening device in the cocked position, wherein the predetermined angle is determined such that a component along the second axis of a component of the tension acting onto the second interacting surface is within a predetermined range for ensuring structural integrity of the water soluble element in the cocked position and for ensuring movement of the plunger when a portion of the water soluble element is dissolved.

In accordance with an embodiment of the present invention there is further provided a water activated inflatable device comprising:

an inflatable device body;

a gas cylinder connected to the inflatable device body; and, a water activated inflator for opening a sealing mechanism of the gas cylinder, the water activated inflator comprising:

a gas cylinder opening device for opening a sealing mechanism of a gas cylinder, the gas cylinder opening device being disposed at least partially within a housing and being movable between a cocked position and a fired position along a first axis having a first orientation relative to the housing;

a tension mechanism in mechanical communication with the housing and the gas cylinder opening device for providing tension acting along the first axis for moving the gas cylinder opening device from the cocked position to the fired position;

a plunger for holding the gas cylinder opening device in the cocked position, the plunger being disposed in the housing and movable between a first position and a second position along a second axis having a second different orientation relative to the housing;

a water soluble element for holding the plunger in the first position through mechanical communication along the second axis with the plunger and the housing;

a conduit for providing water to the water soluble element;

a first interacting element in mechanical communication with the gas cylinder opening device having a first interacting surface, wherein a portion of the first interacting surface is disposed at a predetermined angle other than 0 or 90 degrees to the first axis; and, a second interacting element in mechanical communication with the plunger having a second interacting surface for interacting with the first interacting surface at the predetermined angle when the plunger is in the first position for holding the gas cylinder opening device in the cocked position, wherein the predetermined angle is determined such that a component along the second axis of a component of the tension acting onto the second interacting surface is within a predetermined range for ensuring structural integrity of the water soluble element in the cocked position and for ensuring movement of the plunger when a portion of the water soluble element is dissolved.

In accordance with another embodiment of the present invention there is provided a method of air deployment of a water activated inflatable device comprising:

providing from an aircraft over a body of water a deployment container comprising an inflatable device body, a gas cylinder connected to the inflatable device body and a water activated inflator for opening a sealing mechanism of the gas cylinder;

deploying a parachute attached to the deployment container for aerodynamically braking the descent of the deployment container and for providing a predetermined orientation of the deployment container at impact on the body of water;

activating the water activated inflator through contact with water after impact of the deployment container on the body of water;

using the water activated inflator, pulling a sealing mechanism of the gas cylinder for opening the same; and, inflating the inflatable device body.

In accordance with the other embodiment of the present invention there is further provided a water activated inflatable device for air deployment over a body of water comprising:

an inflatable device body;

a gas cylinder connected to the inflatable device body;

a water activated inflator for opening a sealing mechanism of the gas cylinder, the water activated inflator comprising a gas cylinder opening device attached to the sealing mechanism of the gas cylinder for opening the gas cylinder by pulling the sealing mechanism;

a deployment container containing the inflatable device body, the gas cylinder and the water activated inflator, the deployment container comprising a conduit for enabling provision of water to the water activated inflator after impact of the deployment container on the body of water; and, a parachute attached to the deployment container for aerodynamically braking the descent of the deployment container and for providing a predetermined orientation of the deployment container at impact on the body of water.

BRIEF DESCRIPTION OF THE FIGURES

Exemplary embodiments of the invention will now be described in conjunction with the following drawings, in which.

DETAILED DESCRIPTION OF EMBODIMENTS OF THE INVENTION

The following description is presented to enable a person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the scope of the invention. Thus, the present invention is not intended to be limited to the embodiments disclosed, but is to be accorded the widest scope consistent with the principles and features disclosed herein.

Figure 1A:
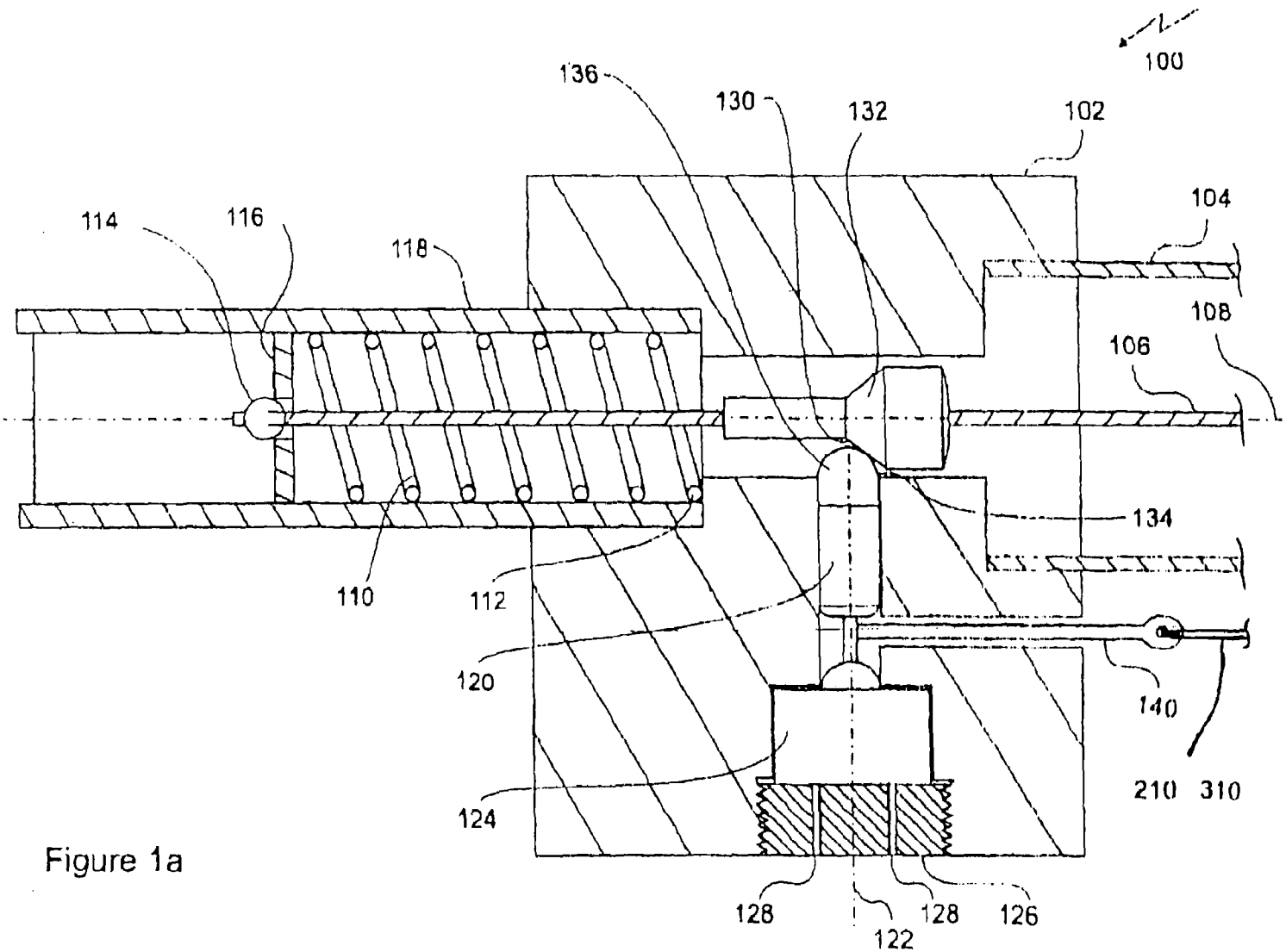
FIGS. 1*a* and 1*b* are simplified block diagrams schematically illustrating a water activated inflator according to an embodiment of the invention.
Figure 1B:
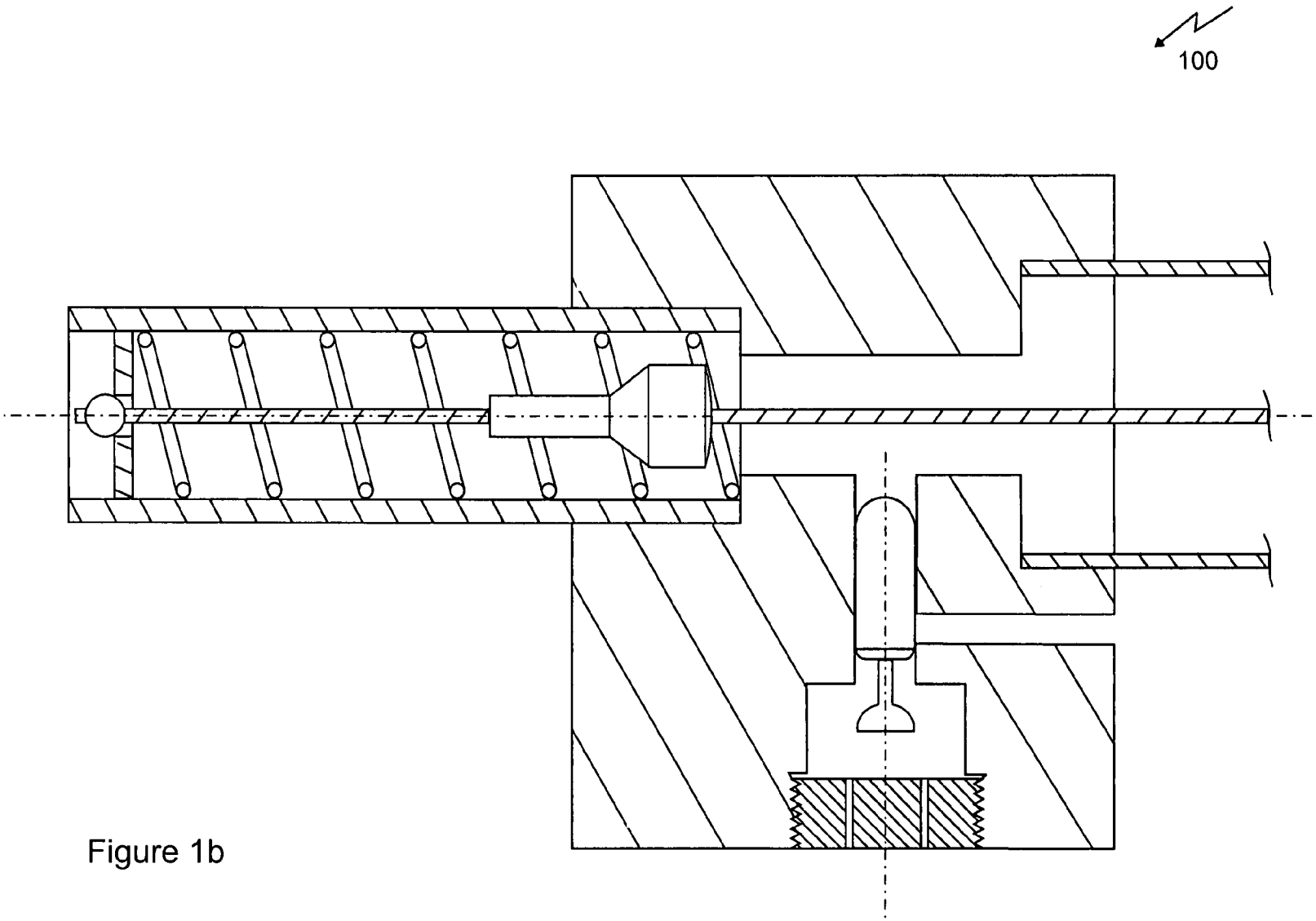
Figure 1C:
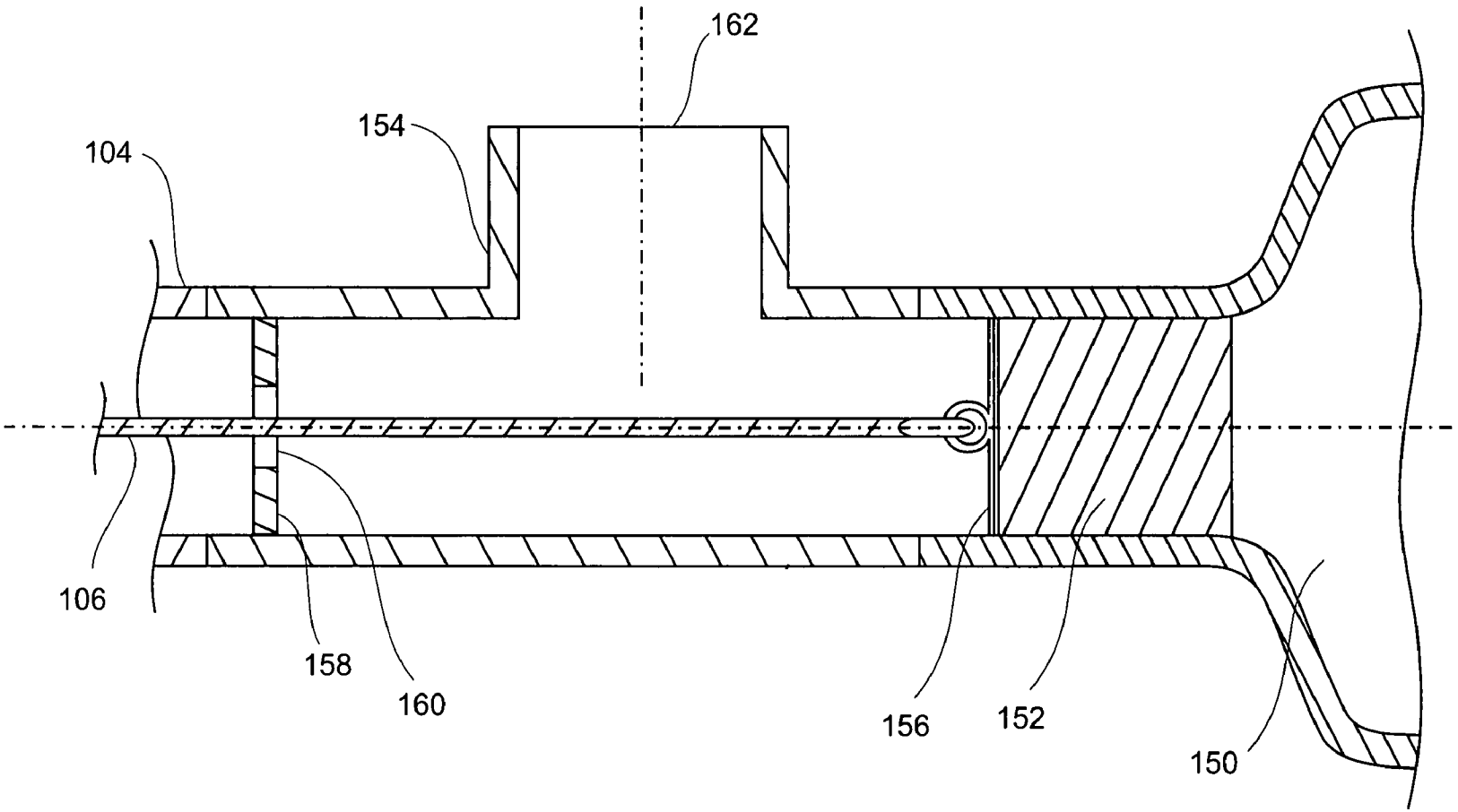
FIGS. 1*c* and 1*d* are simplified block diagrams schematically illustrating a connection of the water activated inflator shown in FIGS. 1*a* and 1*b* to a gas cylinder as a continuation of the FIGS. 1*a* and 1*b;*
Figure 1D:
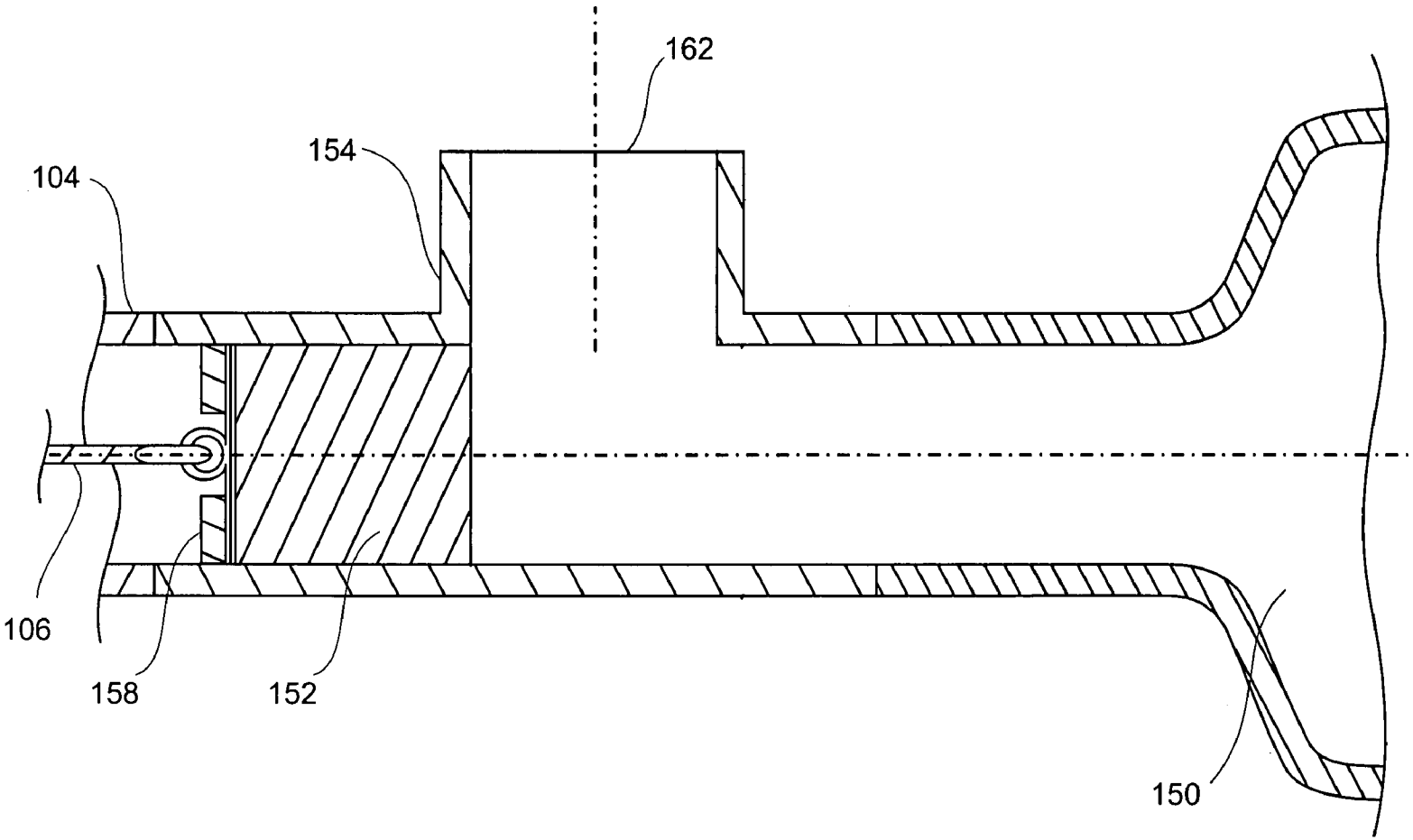

Referring to FIGS. 1*a* and 1*b*, an embodiment of a water activated inflator 100 according to the invention is shown in a cocked position and a fired position, respectively. The inflator 100 comprises a housing 102 having a connecting mechanism 104 for being mated, for example, to a T-section 154 mounted to a neck of gas cylinder 150, as shown in FIGS. 1*c* and 1*d*, which illustrate an exemplary continuation of FIGS. 1*a* and 1*b*, respectively. A gas cylinder opening device 106 for opening a sealing mechanism of the gas cylinder is disposed in a bore of the housing 102 along a first axis 108. The sealing mechanism comprises, for example, a sealing element 152 made of an elastic material disposed in a sealing fashion in the neck of the gas cylinder 150 and capable of withstanding pressure of a gas, for example, $CO_2$ contained in the gas cylinder when disposed therein. The sealing element 152 is connected to the gas cylinder opening device 106 using, for example, a hook interacting with a ring mounted to the sealing element 152. The gas cylinder 150 is opened by providing via the gas cylinder opening device 106 a pulling force acting on the sealing element 152 along a distance such that the sealing element 152 is pulled out the neck of the gas cylinder and that, for example, a sealing surface 156 of the sealing element 152 is in a sealing contact with sealing plate 158 having an aperture 160 for accommodating the gas cylinder opening device 106 therein and disposed in the T-section 154, as shown in FIG. 1*d*. In the opened position shown in FIG. 1*d*, flow of the gas contained in the gas cylinder through the section 162 is enabled for provision to an inflatable member connected thereto, while leakage of the gas into the connecting mechanism 104 is prevented. The gas cylinder opening device 106 is made, for example, using a steel cable, while the connecting mechanism 104 is, for example, a tube made of a rigid material. Optionally, the connecting mechanism 104 is a tube made of a flexible material such as, for example, multiple layers of woven metal wires to facilitate installation of the inflator 100 in the confined space of a deployment container.

Figure 1E:
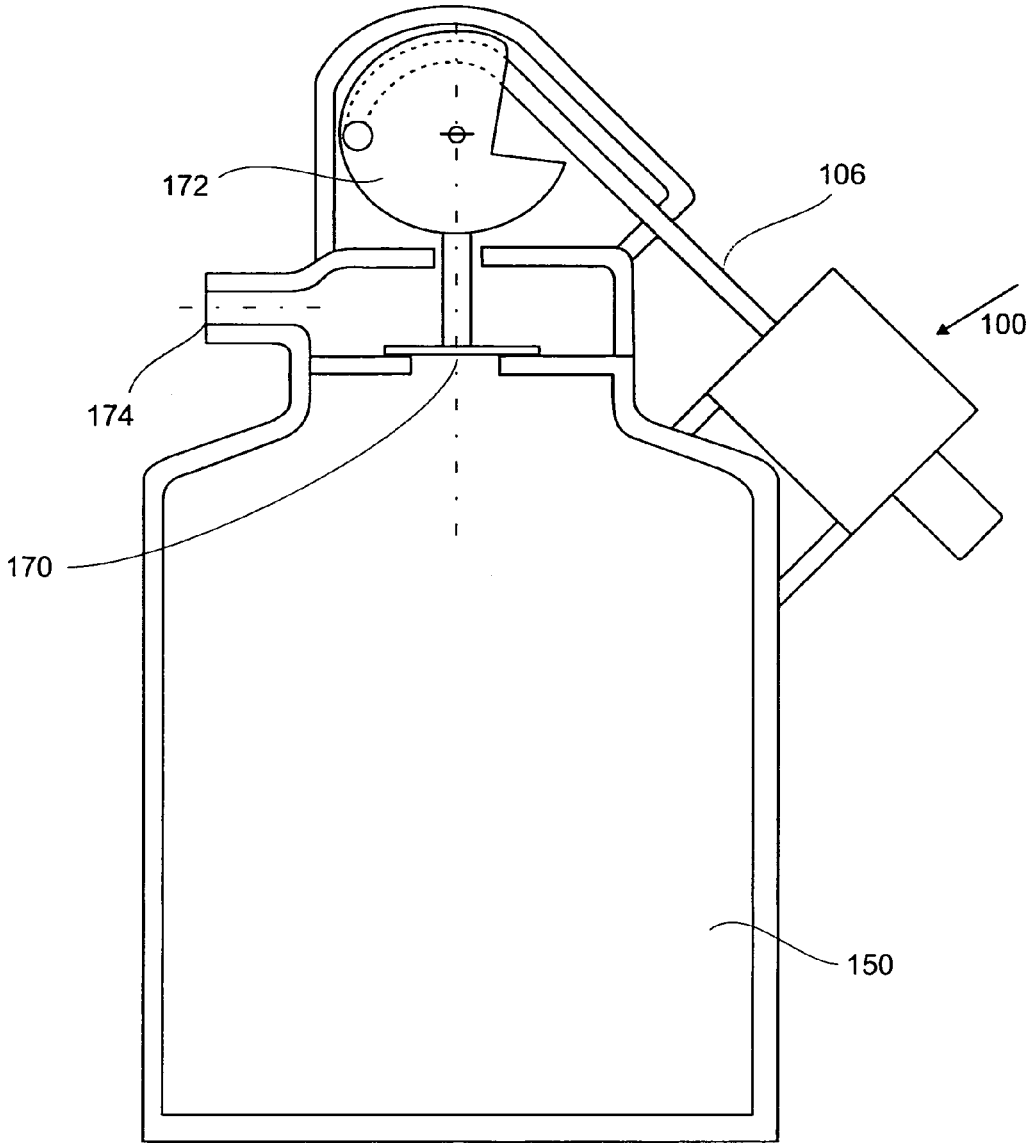
FIGS. 1*e* and 1*f* are simplified block diagrams schematically illustrating a connection of an embodiment of the water activated inflator shown in FIGS. 1*a* and 1*b* to a gas cylinder having an opening mechanism attached thereto.
Figure 1F:
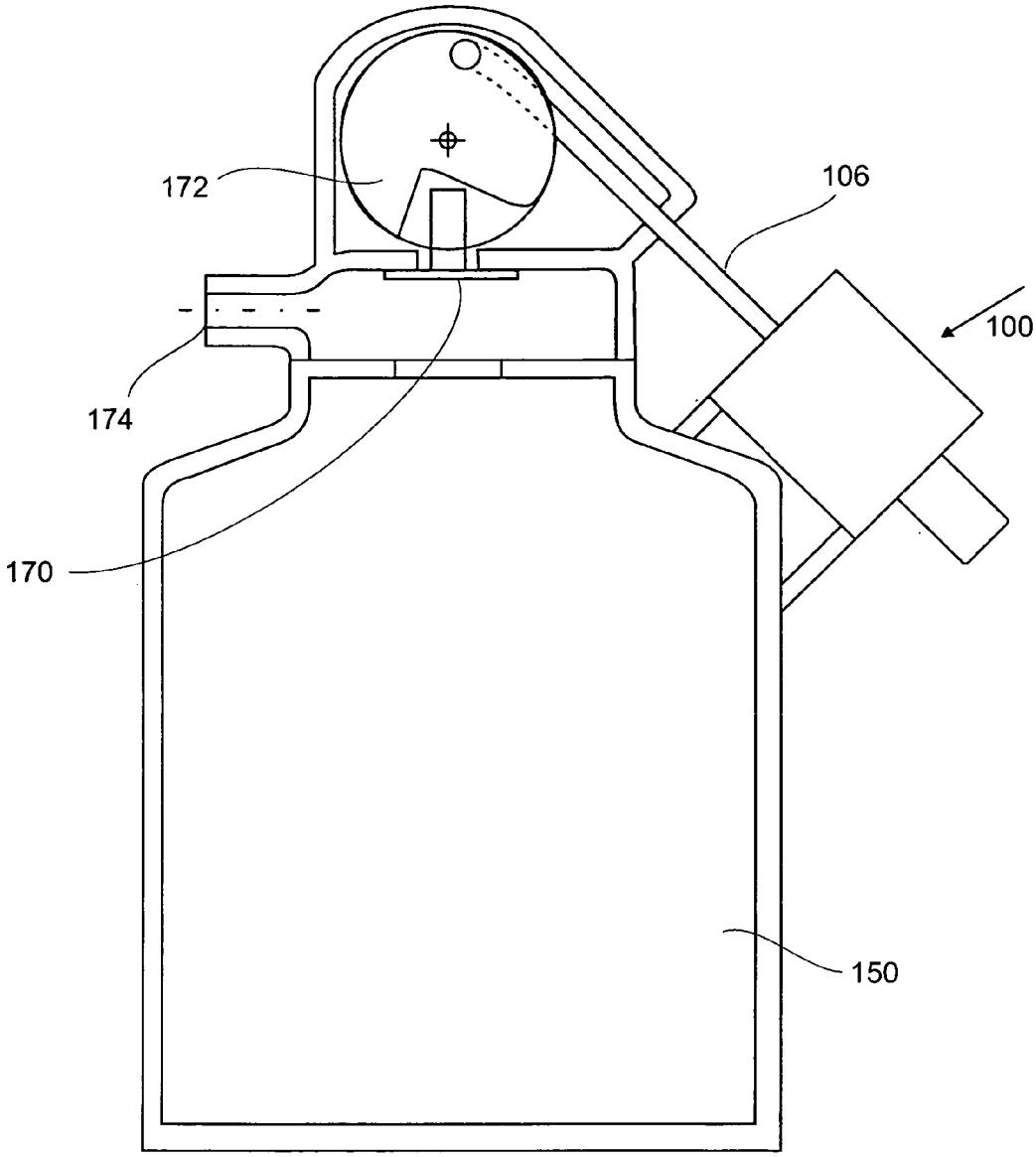

Alternatively, the inflator 100 is used in combination with a gas cylinder having an opening mechanism attached thereto, as shown in FIG. 1*e*. For example, a sealing element 170 is held in a sealing position using cam 172. For opening, the cam 172 is turned clockwise until the sealing element 170 is enabled to move into an opened position, as shown in FIG. 1*f*, enabling flow of the gas contained in the gas cylinder through section 174 for provision to an inflatable member connected thereto. The cam 172 is turned through pulling action provided by the inflator 100 via the gas cylinder opening device 106 connected to the cam 172. The inflator 100 is, for example, mounted to the gas cylinder 150, allowing omission of the connecting mechanism 104.

Figure 1G:
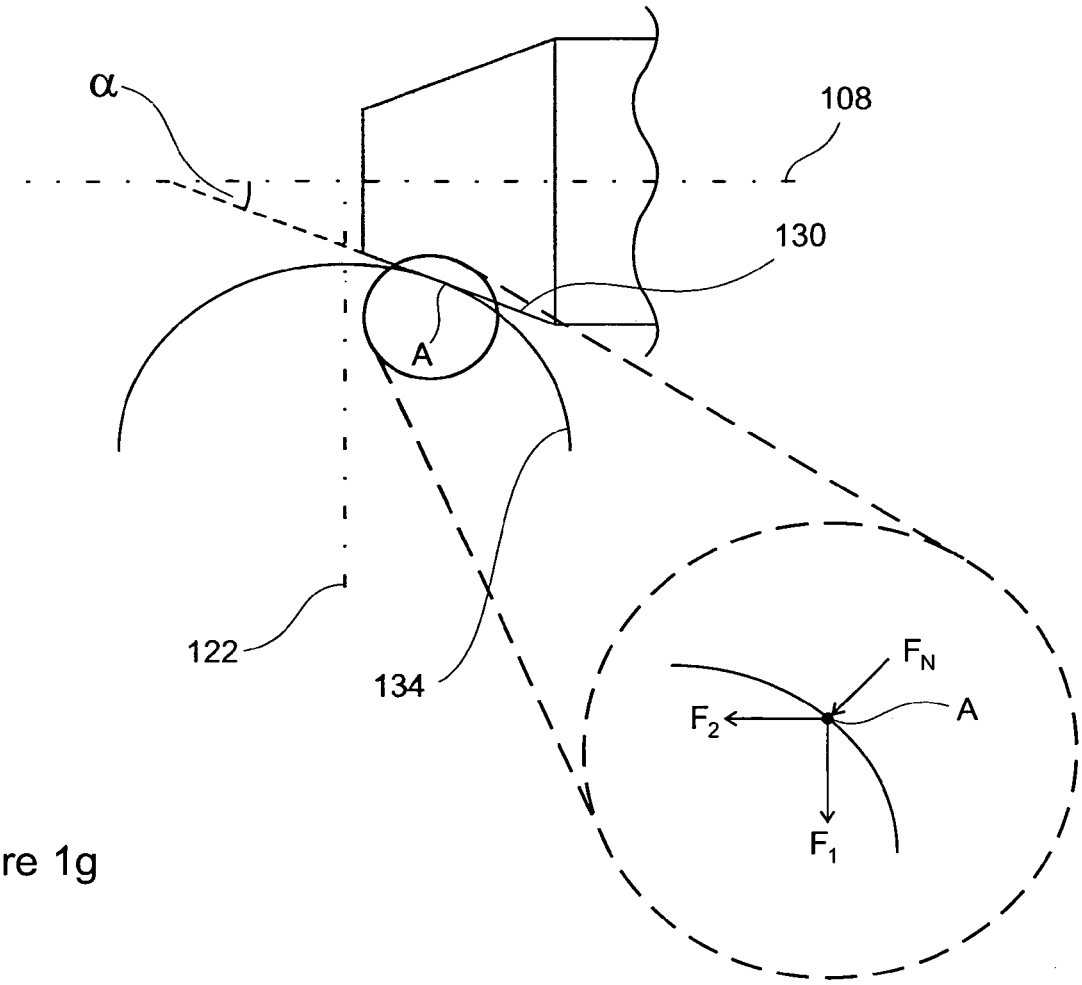
FIG. 1*g* is a simplified block diagram schematically illustrating a detail of the water activated inflator shown in FIGS. 1*a* and 1*b;*

The gas cylinder opening device 106 is movable along the first axis 108 between the cocked position, shown in FIG. 1*a*, and the fired position, shown in FIG. 1*b*. Movement of the gas cylinder opening device 106 is realized using a tension mechanism 110 such as a compression spring in mechanical communication with the housing 102 at point 112 and with the gas cylinder opening mechanism 106 through, for example, a ball 114 attached to the steel cable and a washer 116. The tension mechanism 110 is designed to provide sufficient force F acting along a sufficient distance for opening the sealing mechanism of the gas cylinder. The tension mechanism is partly accommodated in a tube 118 affixed to the housing 102 or, alternatively, the housing 102 is designed large enough to accommodate the complete tension mechanism 110. The gas cylinder opening device 106 is held in the cocked position using a plunger 120. The plunger 120 is disposed in a bore of the housing 102 and movable along a second axis 122 between a first position, shown in FIG. 1*a*, and a second position, shown in FIG. 1*b*. The second axis 122 is oriented substantially perpendicular to the first axis 108. Optionally, the second axis is disposed at a different angle than 90° to the first axis. The plunger 120 is held in the first position through a water soluble element 124—made of, for example, a sugar—disposed between the plunger 120 and a plug 126. The plug 126 is, for example, screwed into a threaded bore of the housing 102 along the second axis 122. The plug 126 comprises conduits 128 for enabling provision of water to the water soluble element 124. Alternatively, the conduits are disposed in the housing 102. The gas cylinder opening device 106 is held in the cocked position through interaction of surface 130 of a first interacting element 132 in mechanical communication with the gas cylinder opening device 106 with surface 134 of a second interacting element 136 in mechanical communication with the plunger 120. As shown in FIG. 1*g*, the interacting surface 130 is disposed at a predetermined angle $\alpha$ other than 0 or 90 degrees to the first axis 108. The angle $\alpha$ is determined such that component $F_1$—acting along the second axis 122—of force $F_N$—component of the force F oriented normal to the surface 130 in contact point A and transmitted to the surface 134—is sufficiently small to ensure structural integrity of the water soluble element in the cocked position but also sufficiently large to ensure movement of the plunger 120 when at least a portion of the water soluble element 124 is dissolved. In the embodiment, shown in FIGS. 1*a*, 1*b*, and 1*g*, the first interacting element 132 comprises a frustocone in interaction with a half sphere forming the second interacting element 136.

Figure 2A:
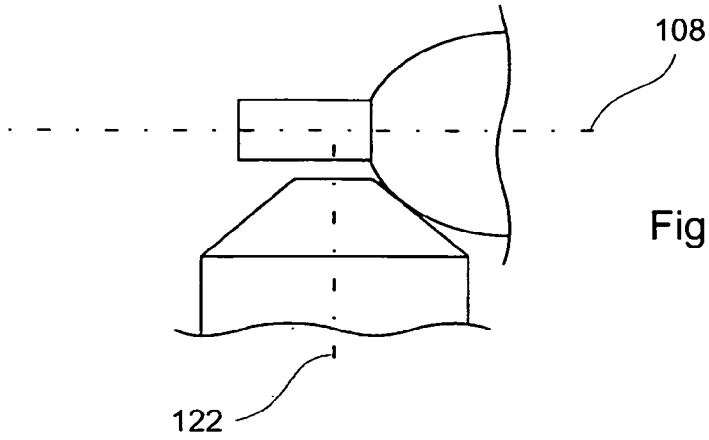
FIGS. 2*a* to 2*c* are simplified block diagrams schematically illustrating various embodiments of interacting elements of the water activated inflator according to the invention.
Figure 2B:
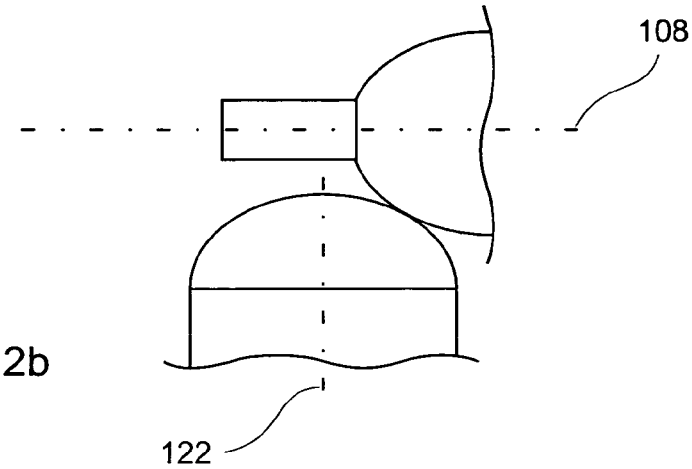
Figure 2C:
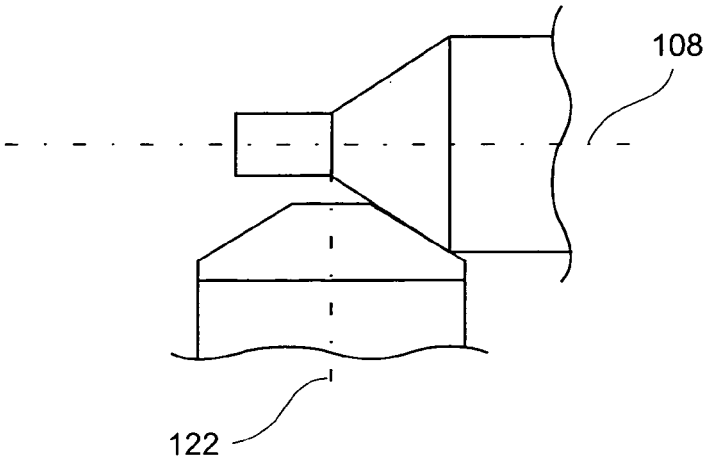

FIGS. 2*a* to 2*c* illustrate alternative embodiments comprising various combinations of spherical and conical surfaces. However, the embodiment shown in FIG. 1*g* is simpler to manufacture, provides a predetermined angle at the contact point A and, in comparison to the embodiment shown in FIG. 2*c*, provides contact in one point instead of a line, thus, minimizing static friction at the instant of firing.

In operation the inflator 100 is connected, for example, via connecting mechanism 104 to the T-section 154 mounted to the neck of a gas cylinder with the gas cylinder opening device being connected to the sealing mechanism of the gas cylinder. During storage and transport of an inflatable life raft the inflator 100 is in the cocked position with the tension mechanism 110 under compression and held in this position by the plunger 120, as shown in FIG. 1*a*. Additionally, the plunger 120 is locked in the first position through safety pin 140 such that a portion of the component $F_1$ is still acting on the water soluble element 124 in order to avoid impact of the plunger 120 on the water soluble element 124 during removal of the safety pin 140. During deployment the safety pin 140 is removed. Optionally, a pull cord 210, 310 attached to the safety pin 140 and a vessel or aircraft carrying the inflatable device is used allowing removal of the safety pin 140 after dropping the inflatable device. After contact with water, the water soluble element 124 starts to dissolve loosing its structural integrity and allowing force $F_1$ to push the plunger 120, thus, enabling the tension mechanism 110 to quickly pull the gas cylinder opening mechanism 106 into the fired position shown in FIG. 1*b*.

The water activated inflator 100 according to an embodiment of the invention is beneficial for air deployment of a life raft by providing a safe, reliable, compact, light weight and simple apparatus which is cost effective to manufacture. It allows use of a simple water soluble element as trigger in a device providing strong force acting along a large distance. Furthermore, the device is easily adaptable to a different stroke by only adjusting the angle $\alpha$ of the interacting surface allowing use of substantially same parts of the inflator for different applications.

Figure 3:
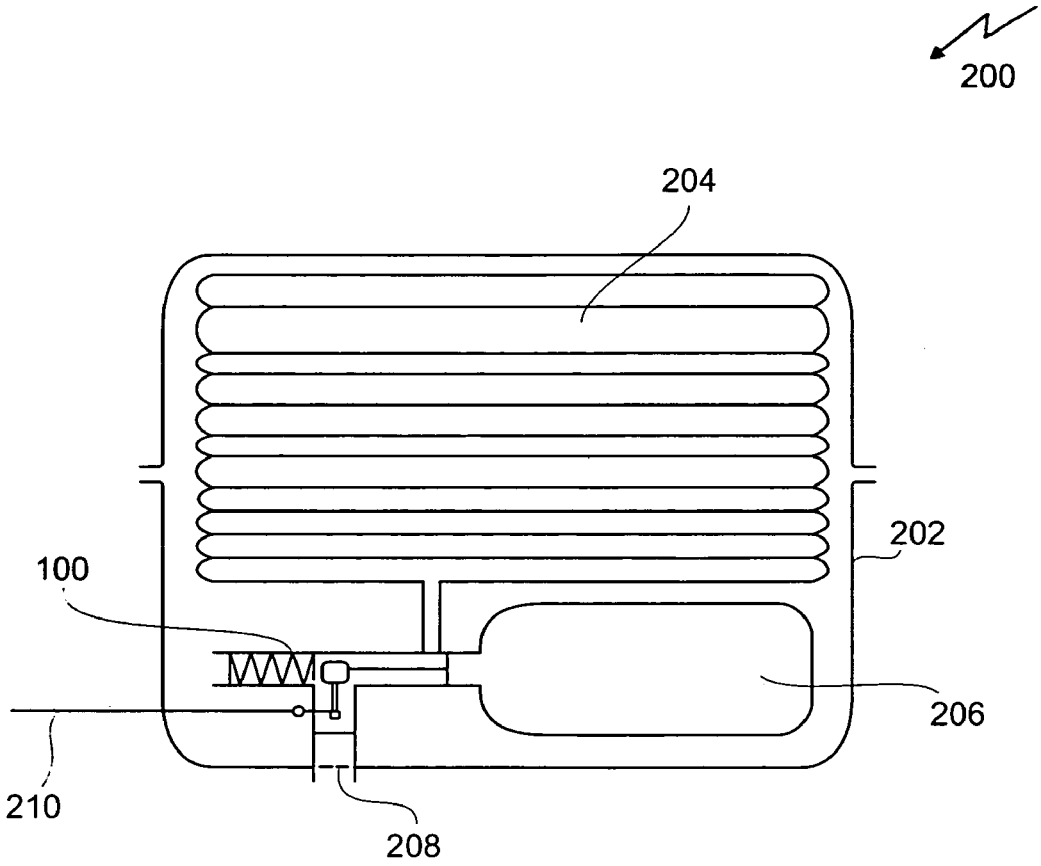
FIG. 3 is a simplified block diagram illustrating a water activated rescue kit according to an embodiment of the invention; and, FIG. 4 is a simplified block diagram illustrating a water activated rescue kit for air deployment according to an embodiment of the invention.

Referring to FIG. 3, a water activated inflatable device 200 according to an embodiment of the invention is shown. A deployment container 202 contains a folded inflatable device body 204 in fluid communication with a gas cylinder 206 comprising a compressed gas such as, for example, $CO_2$, $N_2$, or air. A water activated inflator 100 according to an embodiment of the invention is connected to the gas cylinder 206. The bottom of the deployment container 202 comprises a conduit 208 in order to provide water to the inflator 100 after impact of the container 202 on a body of water. Pull cord 210 is attached to the safety pin of the water activated inflator 100. In use, the pull cord is, for example, attached to a vessel or aircraft carrying the water activated inflatable device 200, allowing automatic removal of the safety pin when the kit is dropped overboard. Optionally, the gas cylinder 206 and the water activated inflator 100 are placed in the bottom portion of the deployment container 202 resulting in the center of gravity of the deployment container and its contents being located below a center of buoyancy of a portion or the complete container 202 immersed in water. This results in a more stable orientation of the container 202 when immersed or floating and, furthermore, the inflator is more quickly in contact with water after impact. Therefore, the risk of the inflatable device being inflated upside down in rough seas is reduced.

Figure 4:
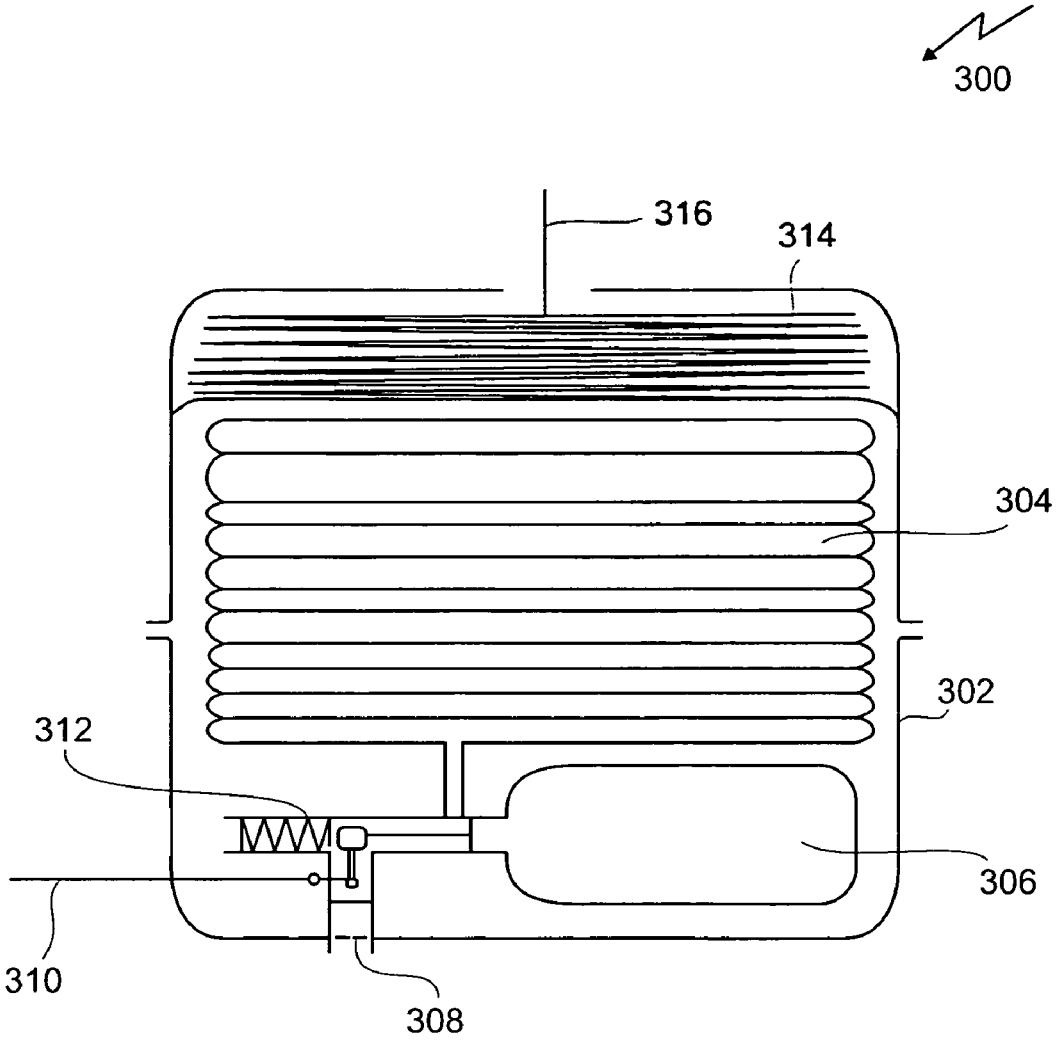

Referring to FIG. 4, a water activated inflatable device 300 for air deployment according to an embodiment of the invention is shown. Here, as in FIG. 3 above, a deployment container 302 contains a folded inflatable device body 304 in fluid communication with a gas cylinder 306 comprising a compressed gas. A water activated inflator 312 according to an embodiment of the invention is connected to the gas cylinder 306. The bottom of the container 306 comprises a conduit 308 to enable provision of water to the inflator 312 after impact of the container 302 on a body of water. A top portion of the container 302 comprises a folded parachute 314 for aerodynamically braking the descent of the container 302 and for ensuring a predetermined orientation of the deployment container 302 at impact on a body of water. Affixed to the folded parachute 314 is a pull cord 316 for being attached to the aircraft. Also for being attached to the aircraft is a pull cord 310 for removing a safety pin of the inflator 312 affixed thereto. Optionally, pull cords 310 and 316 are combined. Optionally, the water activated inflatable device 300 comprises a release mechanism operated by the inflator 312 for opening the deployment container 302. Alternatively, the deployment container 302 is pushed open by the impact on the water or by the inflating life raft. Further optionally, the deployment container 302 has cords affixed thereto for attachment to deployment containers of other water activated inflatable devices in order to connect a plurality of water activated inflatable devices for deployment.

Hereinbelow, a method of air deployment of a water activated inflatable device over a body of water according to an embodiment of the invention will be described. For example, a water activated inflatable device 300 as described above is employed for executing the method. The water activated inflatable device 300 is dropped from an aircraft over a body of water in a target zone where survivors are suspected. After dropping the water activated inflatable device 300 from the aircraft pulling action on pull cord 316 pulls the folded parachute 314 from the deployment container 302 for deployment through interaction with the airflow around the falling deployment container 302. Pulling action on pull cord 310 removes the safety pin from the inflator 312. Alternatively, a same pull cord is used for deploying the parachute as well as for removing the safety pin. The water activated inflatable device 300 is deployed in various different ways, for example, by release from a loading bay of a transport aircraft such as for instance an airplane or helicopter, or from a release mechanism mounted to the outside of an aircraft at the fuselage or under a wing. Deployment of the parachute provides aerodynamically braking of the descent of the water activated inflatable device 300 and ensures a predetermined orientation of the deployment container 302 at impact on the body of water. After impact, the deployment container 302 is first immersed in the body of water, then bobbing in the water and finally floating on the water surface. After impact water is provided through the conduit 308 to the inflator, dissolving a water soluble element of the inflator. After a portion of the water soluble element is dissolved the tension mechanism of the inflator is capable of pushing the plunger and, thus, moving the gas cylinder opening device for providing a sufficient stroke to the sealing mechanism of the gas cylinder. Using the water activated inflator 100 a large opening of the gas cylinder is provided quickly after dissolving a portion of the water soluble element enabling quick inflation of the inflatable device body 304. The inflator 312 and conduit 308 are, for example, placed such that the water soluble element is exposed to water within a short time interval after impact. The deployment container 302 is opened prior inflation of the inflatable device 304 through the force acting at impact or using an opening mechanism activated by the inflator. Alternatively, the deployment container 302 is opened through expansion of the inflating device 304.

Using a water activated inflatable device according to an embodiment of the invention is beneficial for air rescue operations over a body of water. The water activated inflator provides proper timing of the inflation shortly after impact independent of the height of the air plane at the time instant the water activated inflatable device is dropped substantially increasing the likelihood of proper placement of the inflatable device in a target zone as well as substantially increasing safety of the rescue personnel in the aircraft. Since most rescue operations are executed under severe weather conditions, employment of prior art rescue kits using, for example, timing devices, either puts the lives of the rescue personnel in the aircraft at risk by requiring the pilot to fly the aircraft at dangerous heights—below or within a cloud cover for example—for dropping the rescue kit at a given height or substantially reducing the likelihood of proper deployment of the rescue kit by dropping it from a height considered safe by the pilot. Employment of the method of air deployment according to the invention overcomes this dilemma by enabling dropping of the rescue kit from an arbitrary safe height for the aircraft and still providing proper deployment and inflation of the life raft.

Executing numerous drop tests, it has been found that the method for air deployment according to an embodiment of the invention ensures a high success rate for deployment and inflation of the inflatable device. The likelihood of inflation of the life raft upside down has been substantially reduced despite the fact that after impact the rescue kit is immersed in water and then bopping prior inflation.

Numerous other embodiments of the invention will be apparent to persons skilled in the art without departing from the spirit and scope of the invention as defined in the appended claims.

What is claimed is:

1. A water activated inflator comprising:

a gas cylinder opening device for opening a sealing mechanism of a gas cylinder, the gas cylinder opening device being disposed at least partially within a housing and being movable between a cocked position and a fired position along a first axis having a first orientation relative to the housing;

a tension mechanism in mechanical communication with the housing and the gas cylinder opening device for providing a force F acting along the first axis for moving the gas cylinder opening device from the cocked position to the fired position;

a plunger for holding the gas cylinder opening device in the cocked position, the plunger being disposed in the housing and movable between a first position and a second position along a second axis having a second different orientation relative to the housing;

a water soluble element for holding the plunger in the first position through mechanical communication along the second axis with the plunger and the housing;

a conduit for providing water to the water soluble element;

a first interacting element in mechanical communication with the gas cylinder opening device and having a first interacting surface, wherein a portion of the first interacting surface is disposed at a predetermined angle other than 90 or 180 degrees to the first axis; and, a second interacting element in mechanical communication with the plunger and having a second interacting surface for interacting with the first interacting surface at the predetermined angle, such that a component $F_N$ of the force F is oriented normal to the first interacting surface when the plunger is in the first position for holding the gas cylinder opening device in the cocked position, wherein the predetermined angle is determined such that along the second axis a component $F_1$ of the component $F_N$ is within a predetermined range of values for ensuring structural integrity of the water soluble element in the cocked position and for ensuring movement of the plunger when a portion of the water soluble element is dissolved.

2. A water activated inflator as defined in claim 1 wherein the housing comprises a connecting mechanism for mating with a neck of a gas cylinder.

3. A water activated inflator as defined in claim 1 wherein the second axis is oriented substantially perpendicular to the first axis.

4. A water activated inflator as defined in claim 3 wherein the first interacting element comprises a frusto cone.

5. A water activated inflator as defined in claim 4 wherein the second interacting element comprises a half sphere.

6. A water activated inflator as defined in claim 5 wherein the tension mechanism comprises a compression spring.

7. A water activated inflator as defined in claim 6 wherein the gas cylinder opening device comprises a cable for being attached to the sealing mechanism of the gas cylinder.

8. A water activated inflator as defined in claim 7 comprising a tube affixed to the housing along the first axis for accommodating the compression spring.

9. A water activated inflator as defined in claim 7 comprising a plug for holding the plunger and the water soluble element in the first position.

10. A water activated inflator as defined in claim 9 wherein the plug is screwed into a threaded bore of the housing along the second axis.

11. A water activated inflator as defined in claim 9 wherein the conduit is defined through a portion of the plug.

12. A water activated inflator as defined in claim 1 comprising a safety pin in mechanical communication with the plunger and the housing for locking the plunger in the first position.

13. A water activated inflatable device comprising:

an inflatable device body;

a gas cylinder connected to the inflatable device body; and, a water activated inflator for opening a sealing mechanism of the gas cylinder, the water activated inflator comprising:

a gas cylinder opening device for opening a sealing mechanism of a gas cylinder, the gas cylinder opening device being disposed at least partially within a housing and being movable between a cocked position and a fired position along a first axis having a first orientation relative to the housing;

a tension mechanism in mechanical communication with the housing and the gas cylinder opening device for providing tension acting along the first axis for moving the gas cylinder opening device from the cocked position to the fired position;

a plunger for holding the gas cylinder opening device in the cocked position, the plunger being disposed in the housing and movable between a first position and a second position along a second axis having a second orientation relative to the housing that is different than the first orientation;

a water soluble element for holding the plunger in the first position through mechanical communication along the second axis with the plunger and the housing;

a conduit for providing water to the water soluble element;

a first interacting element in mechanical communication with the gas cylinder opening device having a first interacting surface, wherein a portion of the first interacting surface is disposed at a predetermined angle other than 0 or 90 degrees to the first axis; and, a second interacting element in mechanical communication with the plunger having a second interacting surface for interacting with the first interacting surface at the predetermined angle when the plunger is in the first position for holding the gas cylinder opening device in the cocked position, wherein the predetermined angle is determined such that a component along the second axis of a component of the tension acting onto the second interacting surface is within a predetermined range for ensuring structural integrity of the water soluble element in the cocked position and for ensuring movement of the plunger when a portion of the water soluble element is dissolved.

14. A water activated inflatable device as defined in claim 13 comprising a safety pin in mechanical communication with the plunger and the housing for locking the plunger in the first position.

15. A water activated inflatable device as defined in claim 14 comprising a pull cord affixed to the safety pin at a first end and for being affixed to a vessel carrying the inflatable device at a second end, the pull cord for removing the safety pin after dropping of the inflatable device from the vessel.

16. A water activated inflatable device for air deployment over a body of water comprising:

an inflatable device body;

a gas cylinder connected to the inflatable device body;

a water activated inflator for opening a sealing mechanism of the gas cylinder, the water activated inflator comprising a gas cylinder opening device attached to the sealing mechanism of the gas cylinder for opening the gas cylinder by pulling the sealing mechanism;

a deployment container containing the inflatable device body, the gas cylinder and the water activated inflator, the deployment container comprising a conduit for enabling provision of water to the water activated inflator after impact of the deployment container on the body of water; and, a parachute attached to the deployment container for aerodynamically braking the descent of the deployment container and for providing a predetermined orientation of the deployment container at impact on the body of water.

17. A water activated inflatable device for air deployment over a body of water as defined in claim 16 comprising a safety pin for locking the inflator in a cocked position.

18. A water activated inflatable device for air deployment over a body of water as defined in claim 17 comprising a pull cord affixed to the safety pin at a first end and for being affixed at a second end to an aircraft carrying the inflatable device, the pull cord for removing the safety pin after providing of the inflatable device from the aircraft.

19. A water activated inflatable device for air deployment over a body of water as defined in claim 18 comprising a pull cord affixed to the parachute at a first end and for being affixed at a second end to an aircraft carrying the inflatable device, the pull cord for deploying the parachute after providing of the inflatable device from the aircraft.

20. A water activated inflatable device for air deployment over a body of water as defined in claim 16 wherein the inflator comprises a cable attached to a sealing mechanism of the gas cylinder.

21. A water activated inflatable device for air deployment over a body of water as defined in claim 16 wherein components within the deployment container are distributed such that after impact of the deployment container on the body of water a center of gravity of the deployment container and the components is located below a center of buoyancy of a portion of the deployment container immersed in the body of water.

* * * * *